US006505492B2

(12) United States Patent
Jroski

(10) Patent No.: US 6,505,492 B2
(45) Date of Patent: Jan. 14, 2003

(54) METHOD AND APPARATUS FOR FORMING DEEP-DRAWN ARTICLES

(75) Inventor: Robert M. Jroski, Bethlehem, PA (US)

(73) Assignee: Bethlehem Steel Corporation

( * ) Notice: Subject to any disclaimer, the term of this patent is extended or adjusted under 35 U.S.C. 154(b) by 0 days.

(21) Appl. No.: 09/832,995

(22) Filed: Apr. 11, 2001

(65) Prior Publication Data

US 2002/0148272 A1 Oct. 17, 2002

(51) Int. Cl.[7] ..... B21D 22/22
(52) U.S. Cl. ..... 72/348; 72/350
(58) Field of Search ..... 72/347, 348, 349, 72/350, 351

(56) References Cited

U.S. PATENT DOCUMENTS 3,302,441 A * 2/1967 Bozek ..... 72/348
3,481,293 A * 12/1969 Muench ..... 72/348
3,765,206 A 10/1973 Shah et al.
4,745,792 A * 5/1988 Story et al. ..... 72/351
5,083,449 A 1/1992 Kobayashi et al.
5,179,854 A 1/1993 Matsui et al.
5,209,099 A 5/1993 Saunders
5,271,259 A 12/1993 Miller et al.
5,333,484 A 8/1994 Mine et al.
5,722,282 A 3/1998 Mine et al.

FOREIGN PATENT DOCUMENTS

GB 1438207 * 6/1976 ..... 72/350

* cited by examiner

*Primary Examiner*—Lowell A. Larson
(74) *Attorney, Agent, or Firm*—Harold I. Masteller, Jr.

(57) ABSTRACT

The invention is directed to apparatus and a method of using the apparatus to deep draw a blank into a manufactured article. The apparatus includes a die having a cavity to receive the blank being drawn into the product, a clamp adapted to apply an adjustable force against the blank during the drawing operation, and a mandrel comprising a plurality of nested tool segments, the tool segments independently extendable to engage and draw different portions of the blank into the desired product within the cavity.

27 Claims, 7 Drawing Sheets

Fig. 2
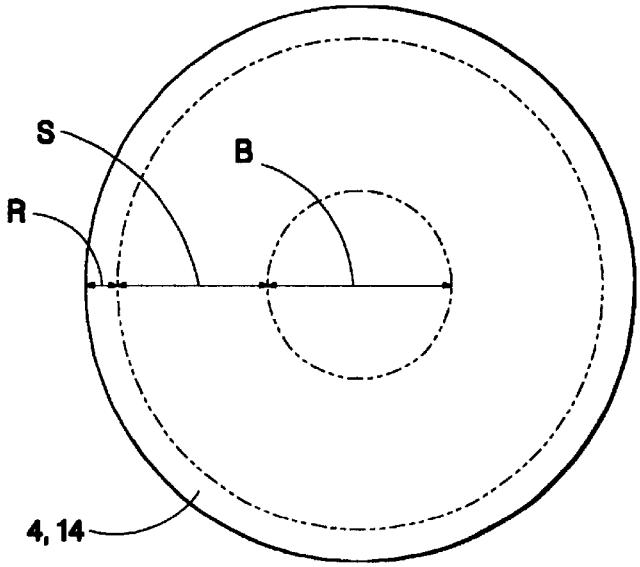
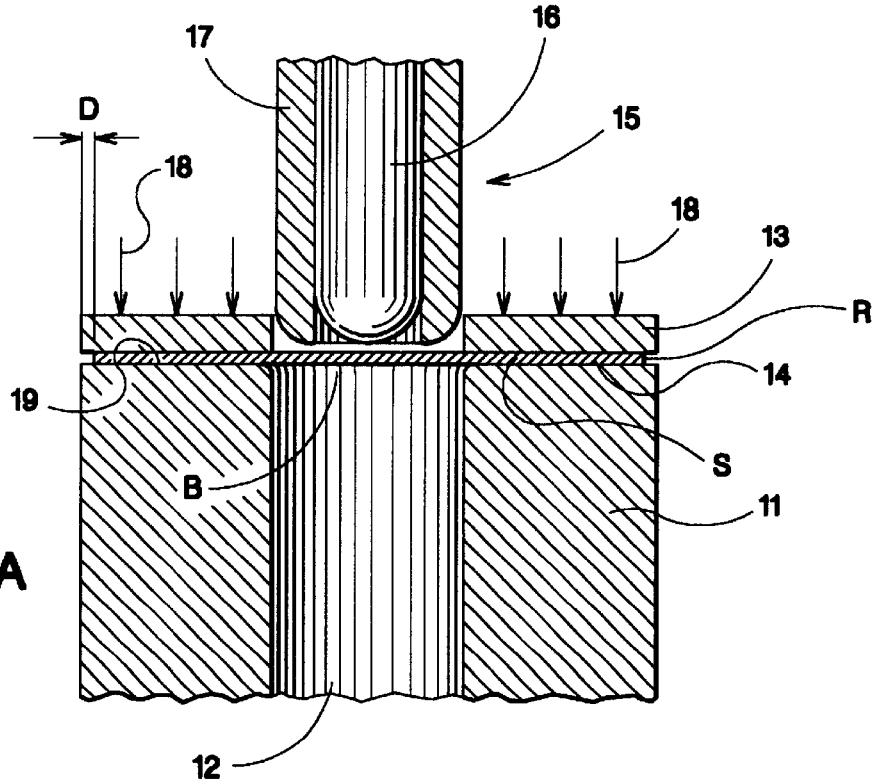
Fig. 3A

METHOD AND APPARATUS FOR FORMING DEEP-DRAWN ARTICLES

FIELD OF THE INVENTION

This invention is directed to a method and apparatus for deep drawing a metal blank to form a finished product, and in particular, it is directed to forming a one-piece finished product by moving, material from the product bottom portion and into the product sidewall portion during the deep drawing operation.

BACKGROUND OF THE INVENTION

Various methods and tooling arrangements have been used in the past to deep-draw and/or iron a metal blank into a one-piece finished product. For example, such metal blanks are deep-drawn into containers for holding food and beverage products as well as non-eatable products. Automotive parts such as oil filters, air conditioner accumulators; and charcoal canisters are also manufactured using deep-drawing technology. Such past apparatus and methods are shown in the patents listed in the information disclosure statement filed with the present patent application. For instance, U.S. Pat. No. 5,209,099, granted to Saunders on May 11, 1993, discloses typical state-of-the-art can forming methods and apparatus comprising a die, a clamp, and a draw punch arrangement used in combination to form a metal blank into a one-piece container; the formed one-piece container having an open end that receives a lid in a downstream manufacturing step. Saunders teaches clamping the cut metal blank against the surface of the die while the draw punch is extended to force portions of the metal blank into the die cavity. In such a deep drawing operation, the draw punch typically approximates the desired size and/or shape of the finished product bottom, and the punch first forces the corresponding bottom portion of the metal blank into the die cavity with little or no working while the sidewall portions of the blank are worked within the die cavity to form the sidewall of the one-piece finished product. As a result of such unequal working along different portions of the metal blank, the finished product has a bottom thickness that is relatively close to the original metal blank thickness, and the product sidewall is greatly reduced in thickness when compared to the original blank thickness.

Although such manufacturing processes produce a one-piece product that is functionally sound from a user viewpoint, the drawing processes of the past are wasteful from a manufacturing viewpoint in that past methods fail to use excess bottom material during the manufacturing process. Therefore, recognizing this, the present invention is directed to providing a method and apparatus that more efficiently uses the metal blank material by moving excess metal from the bottom portion of the deep-drawn product, and into the sidewall portion of the product.

SUMMARY OF THE INVENTION

It is therefore an object of the present invention to provide a method and apparatus for improving the use of available material in a product blank during a deep drawing operation.

It is another object of the present invention to provide a method and apparatus that moves excess material from a formed product bottom to the product sidewall during a deep drawing operation.

It is still another object of the present invention to form a deep-drawn product from a product blank having less blank material when compared with a corresponding product blank used in the past.

Other objects and advantages of the present invention will become apparent as a description thereof proceeds.

In satisfaction of the foregoing objects and advantages, the present invention provides apparatus, and a method of using the apparatus, to draw a product blank into a product. The apparatus includes a die having a cavity to receive the product blank being drawn into the desired product, a clamp adapted to apply an adjustable force against the product blank during the drawing operation, and a mandrel comprising a plurality of nested tool segments, each nested tool segment independently extendable to engage, draw, and form a portion of the product blank within the cavity, the combination of extended nested tools cooperating to form the desired product.

BRIEF DESCRIPTION OF THE DRAWINGS

The above and other objects and advantages and novel features of the present invention will become apparent from the following detailed description of the preferred embodiment of the invention illustrated in the accompanying drawings, wherein:

FIG. 2 is a plan view of a product blank.

FIGS. 3A–3F show the preferred apparatus of the present invention for deep-drawing a product blank into a one-piece product.

DETAILED DESCRIPTION OF THE PREFERRED EMBODIMENT

Prior Art

Figure 1A:
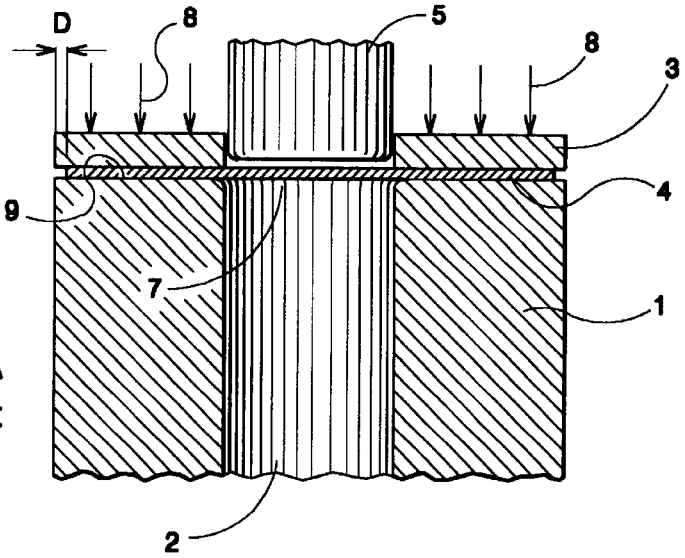
Fig. 1A Prior Art
FIGS. 1A–1C show apparatus used in the past to deep-draw a metal blank into a one-piece product.
Figure 1B:
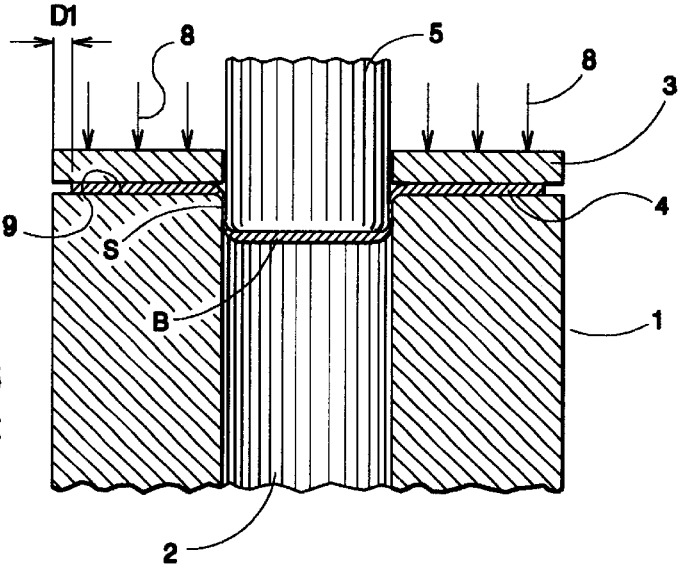
Fig. 1B Prior Art
Figure 1C:
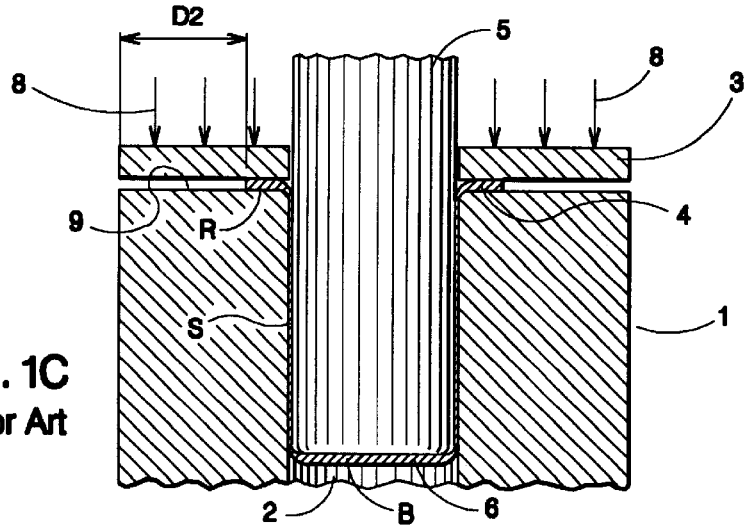
Fig. 1C Prior Art

Referring to FIGS. 1A–1C labeled Prior Art, past apparatus for manufacturing a one piece deep-drawn product 6 typically comprises, in its simplest form, a die 1, a die cavity 2 in which the desired one-piece deep-drawn product is formed, a clamp 3 for holding the product blank 4 against a surface of the die, and a mandrel or draw punch 5 used to force portions of the product blank 4 into the die cavity 2 during the drawing and/or ironing operation that forms the desired one-piece finished product 6 shown in FIG. 1C. As shown in FIG. 1A, the product blank is positioned over the die cavity opening 7 and clamp 3 exerts a calculated force 8 that slidably clamps the product blank 4 to a surface 9 of the die adjacent the die cavity opening 7. The clamping force 8 is calculated so that when mandrel 5 is extended to force the product blank into the die cavity 2 during the drawing and/or ironing operation, the product blank portion that is slidably clamped between the die 1 and clamp 3, slides between the two surfaces to provide a controlled feed of blank material into die cavity 2 during the drawing operation.

Referring in particular to FIG. 2, product blanks 4 are cut so that they provide sufficient blank material for forming the desired deep-drawn product. Such product blanks comprise a bottom portion "B" that corresponds to and provides material to form the bottom potion of the desired one-piece product, a side portion "S" that corresponds to and provides sufficient material to form the sidewall of the product, and a rim portion "R" that remains clamped between the die surface 9 and clamp 3 during the entire drawing and/or ironing operation. Typically, the rim portion "R" is further processed by attaching a lid, or it is shaped to provide a lip or rolled edge that eliminates sharp edges.

As shown in FIG. 1B, mandrel 5 is extended to engage the bottom portion "B" of blank 4 and the extending mandrel forces portion "B" into the die cavity 2 with little or no working along the formed product bottom portion. As mandrel 5 travels deeper within cavity 2, its inward movement causes the sidewall portion "S" of blank 4 to be drawn into the die cavity 2 where portion "S" is reduced in thickness and elongated as it is worked between the die and mandrel surfaces. Referring again to FIG. 1C, as the mandrel moves to its fully extended position within die cavity 2, the sidewall portion "S" is continuously worked to reduce the material to a target thickness as the one-piece deep-drawn product is being formed. Additionally, referring to the product blank positions labeled "D", "D1", and "D2" in FIGS. 1A–1C, as mandrel 5 is moved to its fully extended position within die cavity 2, the blank portions that are slidably clamped between die surface 9 and clamp 3 follow mandrel 5 into the die cavity as the blank portion "S" is formed into the sidewall of the product. As mentioned above, blank 4 is cut so that when mandrel 5 reaches its fully extended position, blank portion "R" is still slidably clamped against an outside surface of the die. Such past deep-drawing operations typically produce a one-piece product having a bottom thickness that approximates the original blank thickness, and a product sidewall reduced to about 40–60% of the original product blank thickness. Consequently, there is little or no working along the product bottom (portion "B"), and therefore, past deep-drawing operations waste blank material during the manufacturing process.

Present Invention

Referring to FIGS. 3A–3F, the preferred embodiment of the present invention comprises a die 11, a die cavity 12 in which the desired one-piece deep-drawn article is formed, a clamp 13 for holding a product blank 14 against a surface of the die, and a mandrel 15 comprising nested tool segments. In the preferred deep-drawing apparatus, the nested tools include a first tool segment 16 slidably captured within a second tool segment 17. The first and second tool segments are independently extendable or retractable with respect to each other, and as shown in FIGS. 3A–3F, the tool segments 16 and 17 are coaxially aligned. However, it should be understood that mandrel 15 may comprise a plurality of nested tool segments that are extendable or retractable along a non-coaxial axis and that the shape of the nested tool segments may be either round or not round.

Figure 3B:
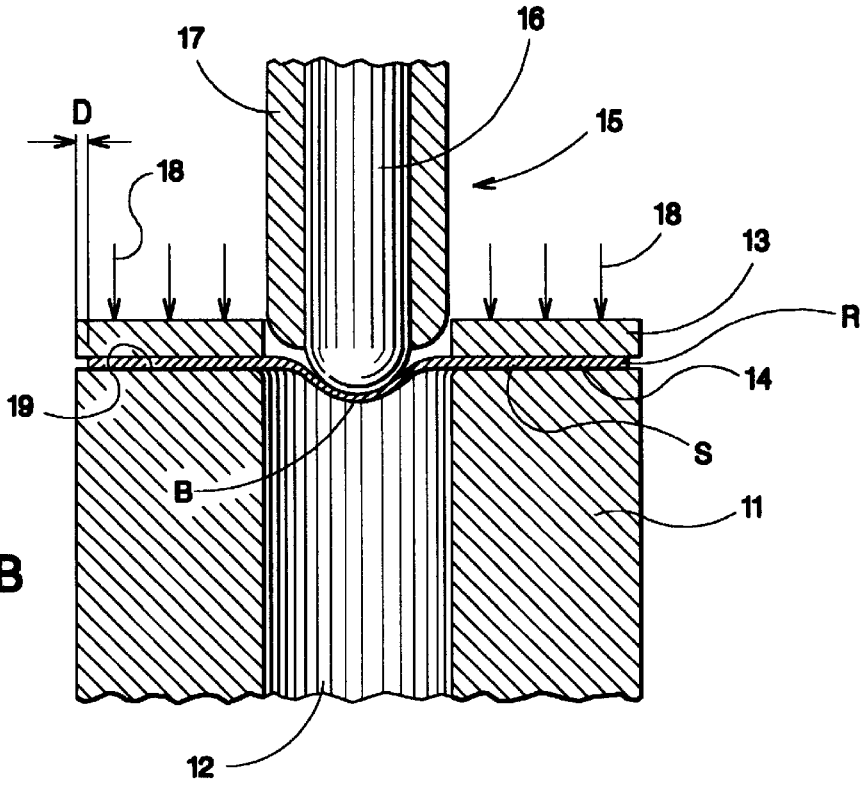
Figure 3C:
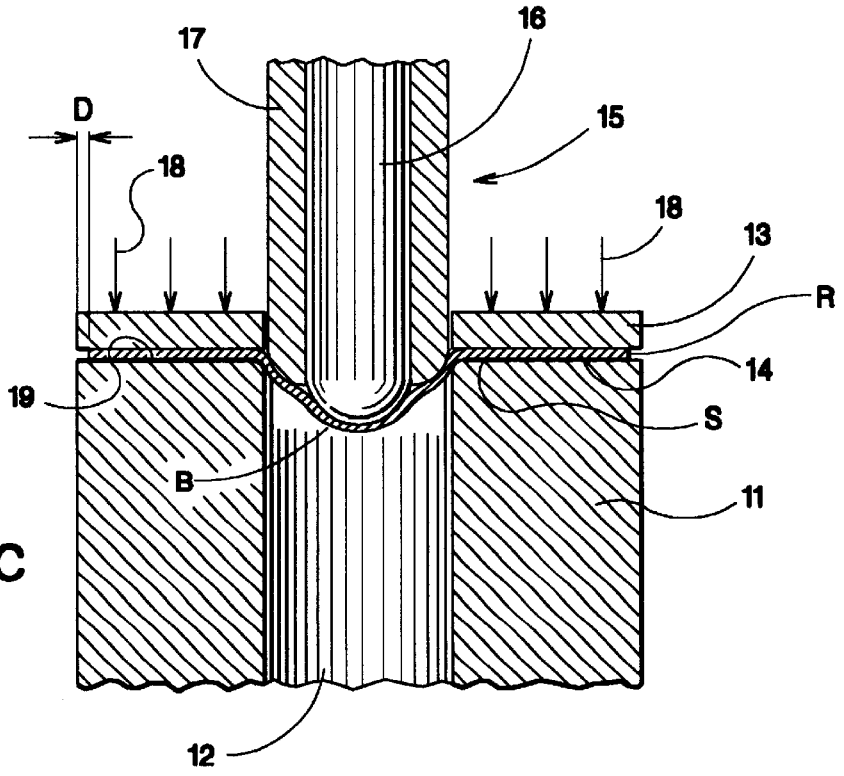
Figure 3D:
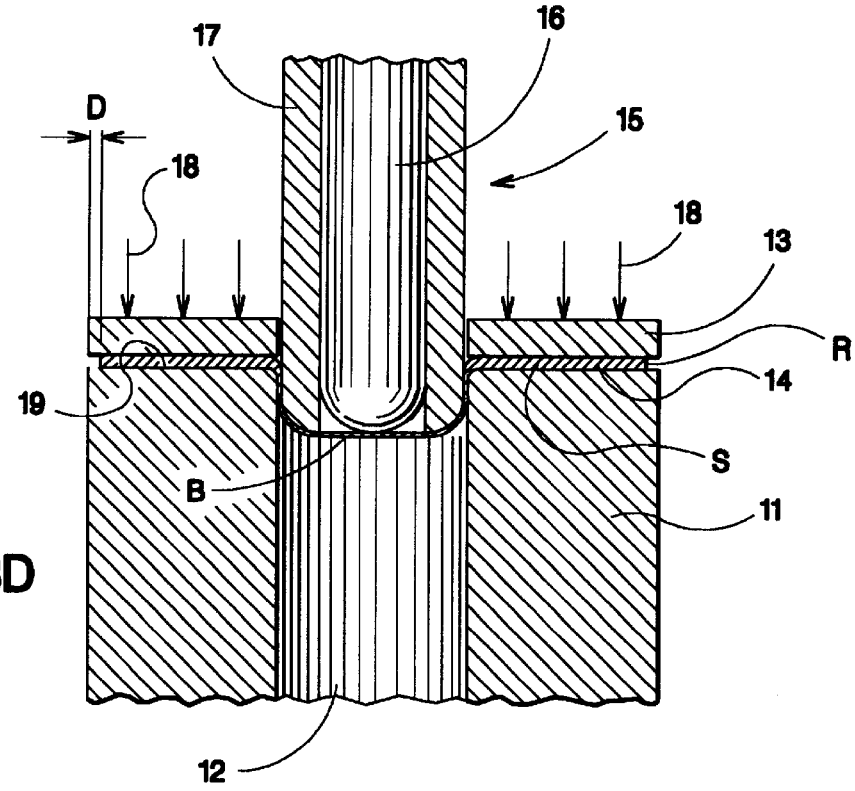

Referring to FIG. 3B and FIG. 3C, blank 14 is positioned on surface 19 of the die so that the bottom portion "B" of blank 14 is located over the die cavity 12 with the edge "R" of the blank located at the edge positions "D" along the die surface. Position "D" is dependent upon the size and shape of the blank required to manufacture the product. As shown in FIG. 3B, the first tool segment 16 is extended to engage and force a surface area portion "B" into the die cavity 12 while the portions "S" and "R" are fixed against surface 19 of die 11. The force exerted by tool segment 16 works portion "B" to provide local thickness reduction as metal or blank material flows outward from the worked surface area and toward the walls of the die cavity 12. The stroke length of tool segment 16 is predetermined so that when it reaches a fully extended position, the worked surface area along portion "B" is reduced to a desired bottom thickness for the article being manufactured. Mandrel 15 is sequentially operated so that the second tool segment 17 is activated to extend along the first tool segment 16 after tool segment 16 is set into motion, and the second tool segment 17 may be activated either while tool segment 16 is being extended to work portion "B", or after the tool segment 16 has reached its fully extended position. In either case, as clearly shown in FIG. 3C, tool segment 17 extends along tool segment 16 to engage portion "B" proximate and outward from the surface area worked by tool segment 16. Because portions "S" and "R" of blank 14 remain fixedly clamped against die surface 19, as illustrated by position "D", the force exerted by tool segment 17 further reduces the product bottom thickness by working remaining excess material outward from portion "B" and toward the wall of die cavity 12 where the excess material becomes part of the product sidewall as shown in FIG. 3D.

Figure 3E:
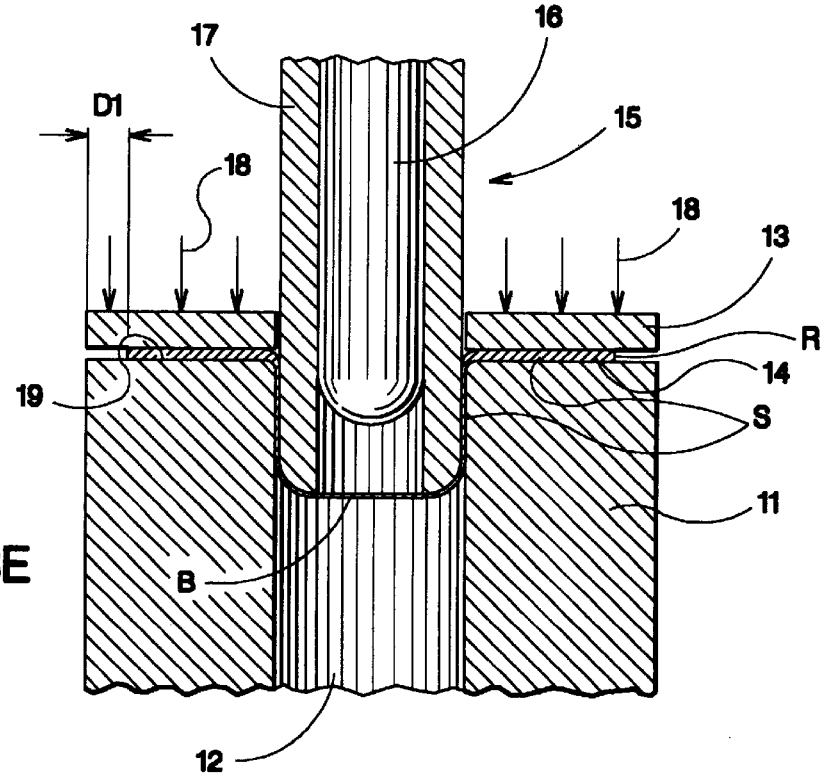

Referring now to FIG. 3E, after the second tool segment 17 has reached a predetermined extended position where the product bottom thickness is reduced to a substantially uniform thinner section, force 18 is reduced so that the product blank 14 is slidably clamped between surface 19 and clamp 13. As illustrated by the different position "D1", the moving tool segment 17 of mandrel 15 draws, or forces, the slidably clamped product blank 14 into die cavity 12 where portion "S" of the product blank is worked or ironed between the die cavity wall and tool segment 17 to form a product sidewall having a desired wall thickness. It should be noted, however, that although the preferred embodiment shows the second tool segment 17 extending outward from the first tool segment 16 as the product sidewall is formed, tool segment 16 may follow the extending tool segment 17 through its full sidewall forming stroke without departing from the scope of this invention.

Figure 3F:
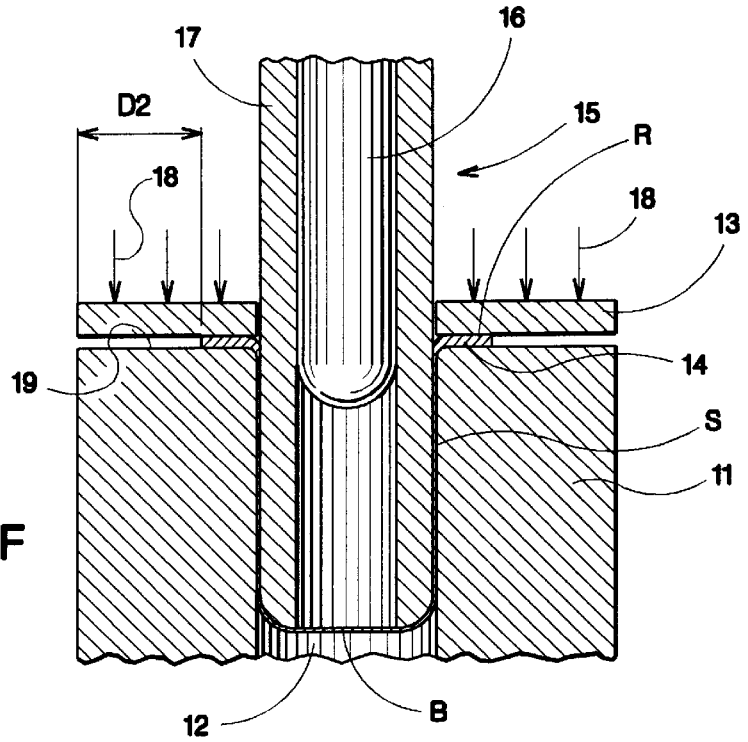

Referring to FIG. 3F, as the second tool segment 17 moves to its fully extended position within die cavity 12, the sidewall portion "S" is continuously worked to form a one-piece deep-drawn product having a target sidewall thickness. As clearly illustrated by the different product blank positions labeled "D", "D1", and "D2" in FIGS. 3A–3F, as the second tool segment 17 is moved to its fully extended position within die cavity 12, the blank portions that are slidably clamped between die surface 19 and clamp 13 follow the second tool segment 17 into the die cavity where the blank portion "S" is formed into the sidewall of the product. Similar to past deep-drawing methods, blank 14 are cut so that when the second tool segment 17 reaches its fully extended position, blank portion "R" is still slidably clamped against surface 19 of the die. Because the present segmented mandrel 15 provides means for improved working of excess metal along the bottom portion "B", less blank material, for example a smaller cut blank size, is needed to manufacture a particular deep-drawn product when compared with the prior art.

Referring to FIGS. 4A–4E, as heretofore mentioned, the present invention is not limited to a segmented mandrel having coaxial or circular tool segments. For instance, FIG. 4A discloses a deep-drawing apparatus having a die 21, a die cavity 22 in which a desired one-piece deep-drawn product is formed, a clamp 23 for holding the product blank 24 against a surface of the die, and a segmented mandrel 25. Mandrel 25 includes a first tool segment 26 slidably captured within a second tool segment 27, and segment 27 is slidably captured within a third tool segment 30. The tool segments, 26, 27, and 30 are independently extendable or retractable with respect to each other.

Figure 4A:
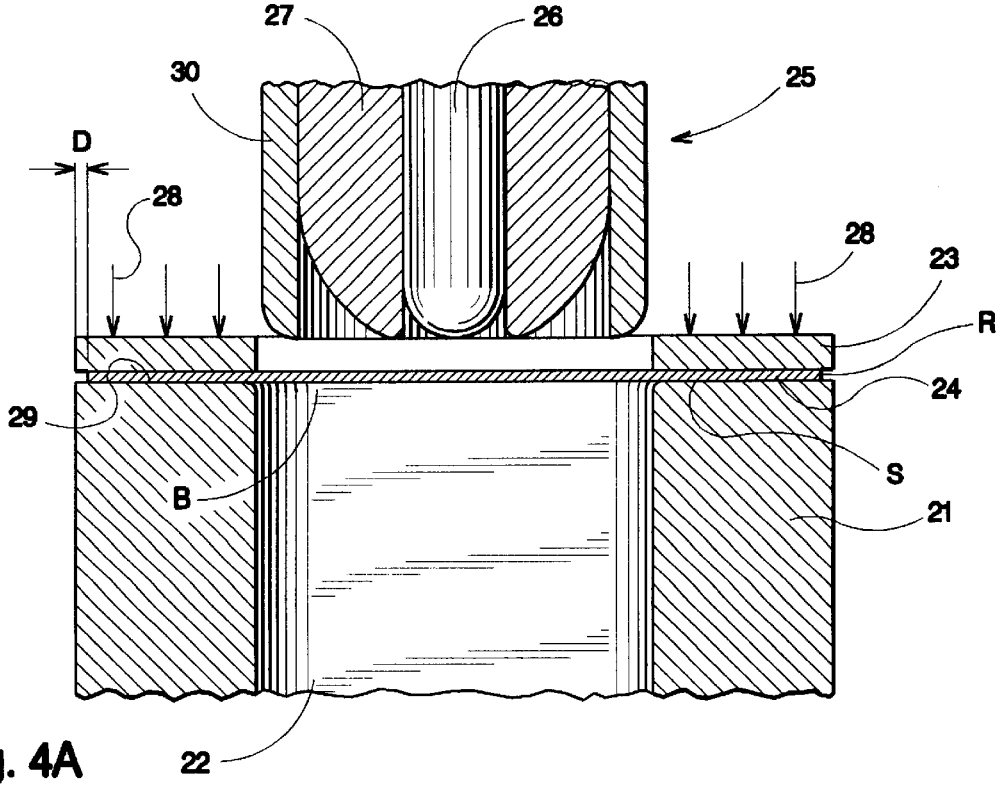
FIGS. 4A–4E show an alternate embodiment of the apparatus for deep-drawing a product blank into a one-piece product.
Figure 4B:
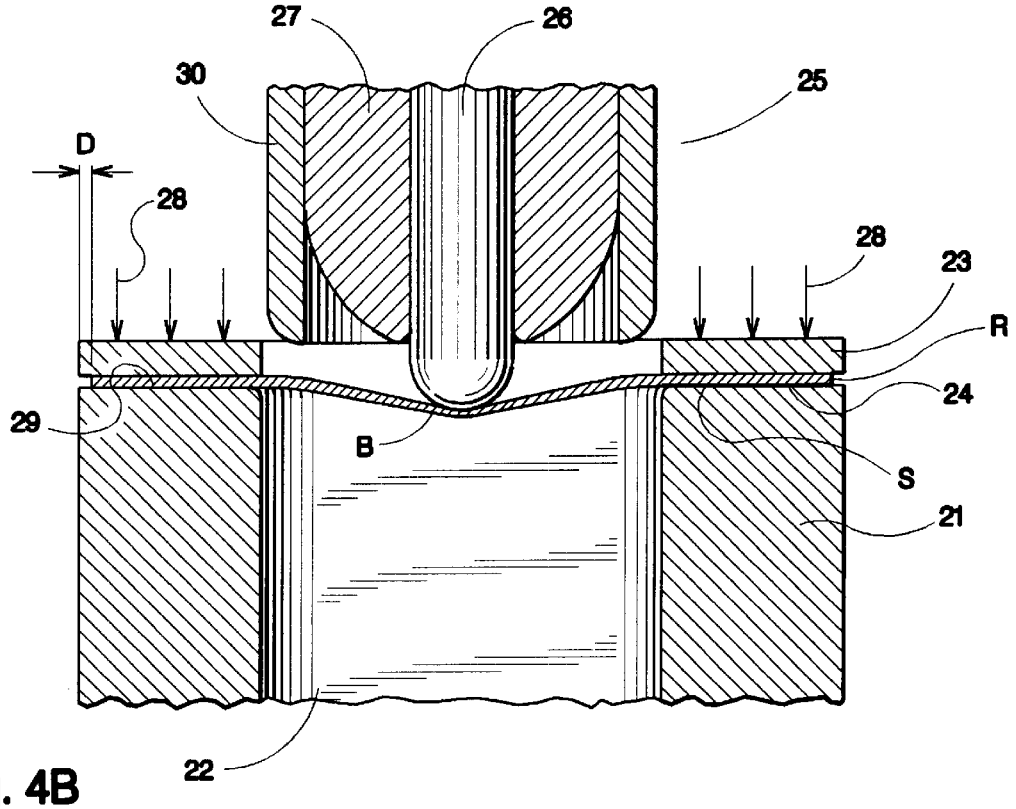
Figure 4C:
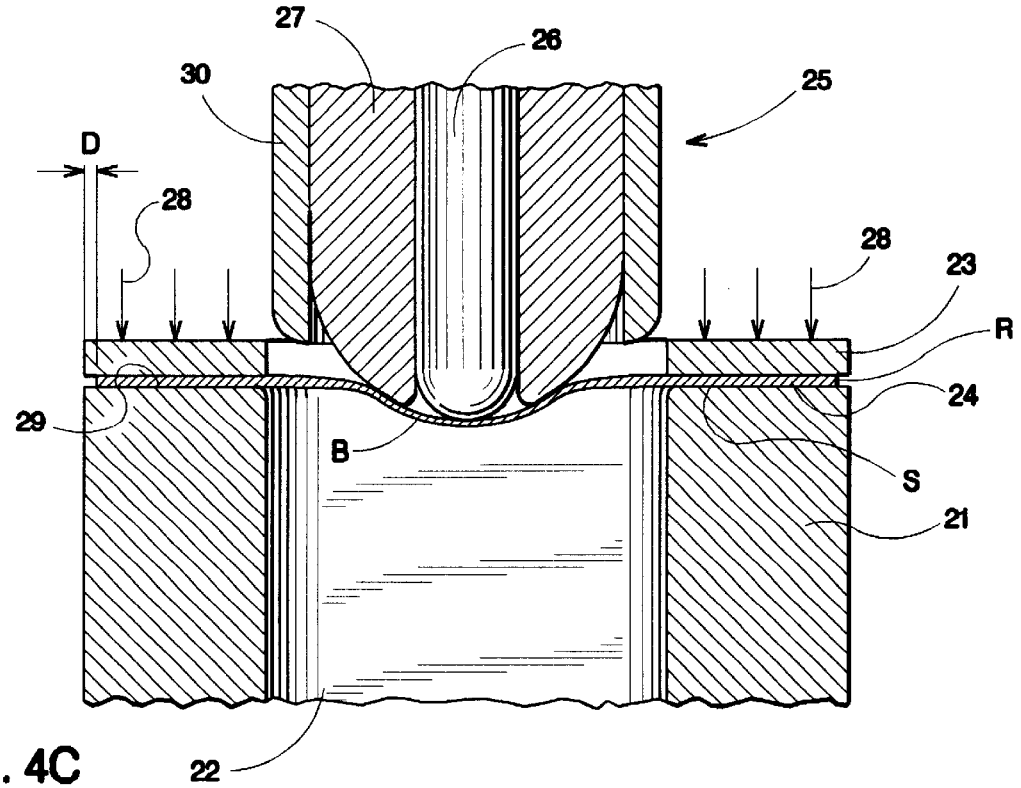

Blank 24 is positioned on surface 29 so that the bottom portion "B" of the product blank is located over the die cavity 22 with the edge of the blank portion "R" located at the edge positions "D" on the die surface, position "D" being dependent upon the size and shape of the blank required to manufacture the product. As shown in FIG. 4B, the first tool segment 26 is extended to engage and force a surface area of portion "B" into the die cavity 22 while portions "S" and "R" are fixed against surface 29 of die 21. The force exerted by tool segment 26 works portion "B" to provide local thickness reduction as metal moves outward from the worked surface area and toward the walls of the die cavity. The stroke length of tool segment 26 is predetermined so that when it reaches a fully extended position, the worked surface area of portion "B" is reduced to a desired thickness for the product bottom.

Mandrel 25 is sequentially operated so that the second tool segment 27 is activated to extend along the first tool segment 26 after tool segment 26 is set into motion, and the second tool segment 27 may be activated while tool segment 26 is working material along the product bottom, or after tool segment 26 has reached its fully extended position. In any event, as clearly shown in FIG. 4C, tool segment 27 extends along tool segment 26 to engage a second surface area of portion "B" proximate and outward from the surface area worked by tool segment 26. Because portions "S" and "R" of blank 24 remain fixed against die surface 29, as illustrated by edge position "D", the force exerted by tool segment 27 against blank 24 reduces the product bottom thickness by further working excess bottom material outward from the tool segment 27 and toward the wall of die cavity 22.

Figure 4D:
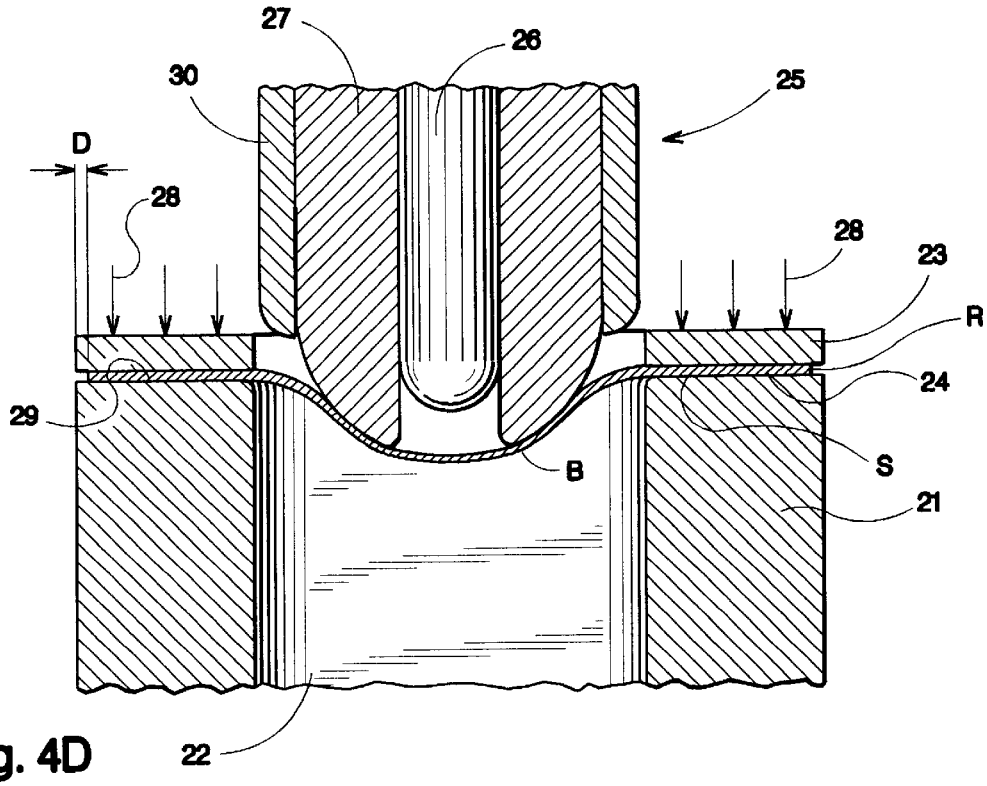

Referring now to FIG. 4D, mandrel 25 continues to be sequentially operated so that the third tool segment 30 is activated to extend along the second tool segment 27 after tool segment 27 is set into motion, and the third tool segment 30 may be activated while both tool segments 26 and 27 are working material along the product bottom portion B, or after either one of the tool segments 26 or 27 have reached a fully extended position. In any event, as clearly shown in the drawing, tool segment 30 extends along tool segment 27 to engage a third surface area of portion "B" proximate and outward from the surface area worked by tool segments 26 and 27. Because portions "S" and "R" of blank 24 continue to be fixed against die surface 29, as illustrated by edge position "D", the force exerted by tool segment 30 against blank 24 reduces the product bottom thickness by working remaining excess bottom material outward from the tool segment and toward the wall of die cavity 22 where the excess material becomes part of the product sidewall as shown in FIG. 4D.

Figure 4E:
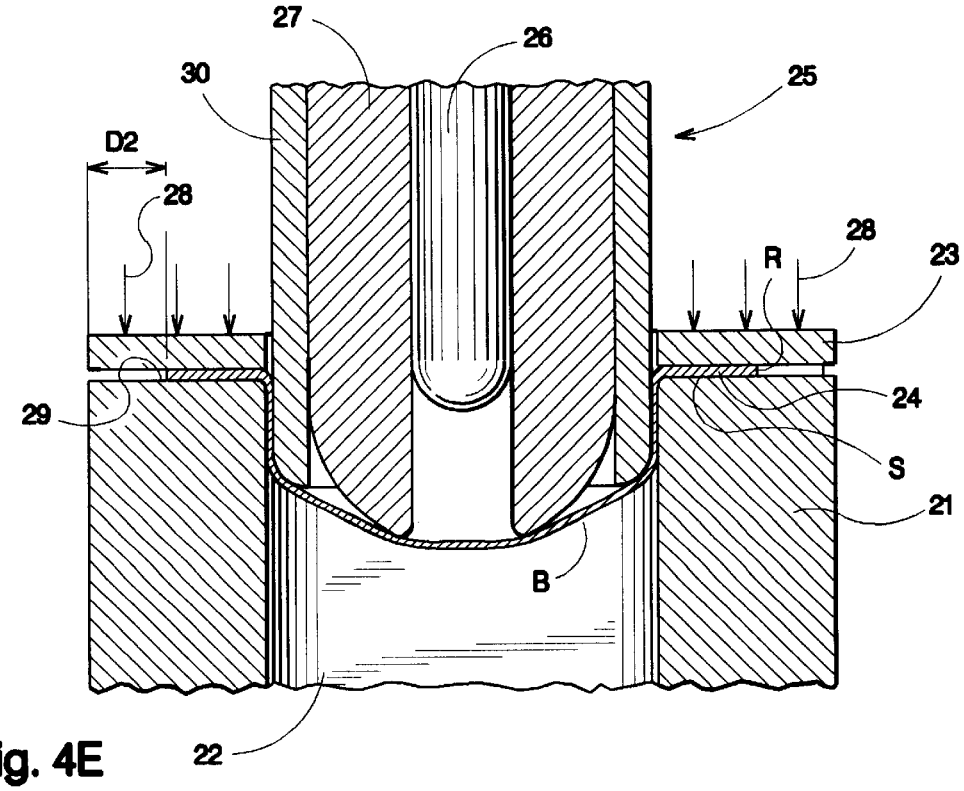

Referring now to FIG. 4E, after the third tool segment 30 has reached a predetermined extended position, where the product bottom "B" is worked to a substantially uniform desired thickness, force 28 is reduced so that blank 24 is slidably clamped between surface 29 and clamp 23. As illustrated by the different edge position "D3" in FIG. 4E, the moving tool segment 30 of mandrel 25 drags, or forces, the slidably clamped portion "S" of blank 24 into die cavity 22, and portion "S" is worked or ironed between the die cavity wall and tool segment 30 to form a product sidewall having a desired wall thickness. The third tool segment 30 continues to move toward its fully extended position within die cavity 22, and the following sidewall portion "S" is worked to form a one-piece deep-drawn article having a target sidewall thickness. As clearly illustrated by the different product blank edge positions labeled "D" and "D3" in FIGS. 4A–4E, as the third tool segment 30 is moved to its fully extended position within die cavity 22, the blank portions that are slidably clamped between die surface 29 and clamp 23 follow the third tool segment 30 into the die cavity where the blank portion "S" is worked to provide a product sidewall. As in the past, blank 24 is cut so that when the third tool segment 30 of mandrel 25 reaches its fully extended position, blank portion "R" is still positioned between the die surface 29 and clamp 23. Because the segmented mandrel 25 of the present invention provides means for reducing portion "B" thickness, a desired deep-drawn product may be manufactured with less blank material when compared to the same product blank manufactured with prior art teaching.

While this invention has been described as having a preferred design, it is understood that the invention is capable of further modifications, uses, and/or adaptations which follow in general the principal of the present invention and includes such departures from the present disclosure as come within known or customary practice in the art to which the invention pertains and that may be applied to the central features here and before set forth and fall within the scope of the limits of the appended claims.

I claim:

1. Apparatus for drawing a blank into a product, comprising:

a) a die having a cavity;

b) a clamp to hold the blank; and c) a mandrel including at least two tool segments comprising an inner first tool segment slidably captured within an outer second tool segment, said first tool segment and said second tool segment independently extendable so that said first tool segment engages and forms the blank before said second tool segment engages and forms the blank into the product within said cavity.

2. The invention recited in claim 1 wherein said clamp is adapted to apply an adjustable force against the blank.

3. The invention recited in claim 1 wherein said clamp applies a force that fixes the blank at a position so that when said first tool segment is extended to draw the first portion of the blank within said cavity, said first tool segment capable of generating a force against the fixed blank that reduces thickness along the first portion of the blank.

4. The invention recited in claim 1 wherein said second tool segment is positioned to engage and draw a second blank portion within said cavity when said second tool segment is extended.

5. The invention recited in claim 4 wherein:

a) said clamp applies a force that fixes the blank at a position so that when said second tool segment is extended, said second tool segment draws the second blank portion to a first position within said cavity, said second tool segment capable of generating a force against the fixed blank that reduces thickness along the second blank portion; and b) said clamp applies a reduced force to allow controlled blank movement when said second tool segment is extended from said first position to a second position within said cavity, the moveable blank drawn within said cavity to form the product when said second tool segment is extended to said second position.

6. The invention recited in claim 1 wherein said apparatus includes means to operate said at least two tool segments sequentially.

7. The invention recited in claim 1 wherein said apparatus includes means to operate said at least two tool segments simultaneously.

8. Apparatus for deep-drawing a blank into a product, comprising:

a) a die having a cavity shaped to receive and form a blank into the product;

b) a clamp that provides an adjustable force to control the position of the blank with respect to said cavity; and c) a mandrel having a plurality of nested tool segments, each nested tool segment independently extendable so that a first inner most nested tool segment engages and draws a first portion of the blank within said cavity before a last outer most nested tool segment engages and draws a last portion of the blank within said cavity.

9. The invention recited in claim 8 comprising:

a) at least one intermediate nested tool segment between said first inner most nested tool segment and said last outer most nested tool segment, said at least one intermediate nested tool segment positioned to engage and draw an intermediate blank portion within said cavity before said last outer most nested tool segment engages and draws a last portion of the blank within said cavity.

10. The invention recited in claim 9 wherein:

a) said clamp applies a force that fixes the blank at a position so that when said first inner most nested tool segment is extended to engage and draw the first blank portion within said cavity, said first inner most nested tool segment generates a force against the fixed blank that reduces thickness along the first blank portion.

11. The invention recited in claim 9 wherein:

a) said clamp applies a force that fixes the blank at a position so that when said at least one intermediate tool segment is extended to engage and draw the intermediate blank portion within said cavity, said at least one intermediate tool segment generates a force against the fixed blank that reduces thickness along the intermediate blank portion.

12. The invention recited in claim 9 wherein:

a) said clamp applies a force that fixes the blank at a position so that when said last outer most nested tool segment is extended to a first position, said last outer most nested tool segment will engage and draw the last blank portion within said cavity, said last outer most nested tool segment capable of generating a force against the fixed blank that reduces thickness along the last blank portion; and b) said clamp applies a reduced force that allows controlled blank movement when said last outer most nested tool segment is extended from said first position to a second position within said cavity, the moveable blank drawn within said cavity by said last outer most nested tool segment to form the product.

13. The invention recited in claim 8 wherein said apparatus includes means to operate said plurality of nested tool segments sequentially.

14. The invention recited in claim 8 wherein said apparatus includes means to operate said plurality of nested tool segments simultaneously.

15. A method for drawing a blank into a product comprising:

clamping the blank to a die;

providing a mandrel having nested tool segments, each tool segment slidably captured within an adjacent tool segment with a last tool segment slidably enveloping a tool segment;

extending said nested tool segments sequentially so that a first inner most nested tool segment engages and draws a first portion of the blank within said cavity before a last outer most nested tool segment engages and draws a last portion of the blank within said cavity to engage and draw within said die a portion of the blank to form the product.

16. The method recited in claim 15, comprising:

adjusting said clamp to apply a force that fixes the blank to said die extending said nested tool segments to engage and draw a portion of the blank within said die to form a partial product;

adjusting said clamp to apply a reduced force that allows controlled blank movement, and extending said last tool segment is to engage and draw the moveable blank portion within said die to form a completed product.

17. The method recited in claim 15, wherein the step extending said nested tool segments sequentially includes:

extending said first inner most nested tool segment from said nested tool segments;

engaging the first blank portion of the clamped blank with said extending first inner most nested tool segment; and drawing the first blank portion of the clamped blank within said die, said first inner most nested tool segment generating a force against the clamped blank capable of reducing thickness along the engaged first blank portion.

18. The method recited in claim 17 further including:

extending said last outer most nested tool segment;

engaging the last blank portion of the fixed blank with said extending last outer most nested tool segment;

drawing the last blank portion of the fixed blank to a first position within said die, said last outer most nested tool segment generating a force against the fixed blank capable of reducing thickness along the engaged last portion;

adjusting said clamp to apply said reduced force that allows controlled blank movement;

extending said last outer most nested tool segment from said first position to a second position within said die, said extending last outermost nested tool segment drawing the moveable blank portion within said die to form a completed product.

19. The method recited in claim 15 wherein said nested tool segments are extended sequentially.

20. The method recited in claim 15 wherein said nested tool segments are extended simultaneously.

21. Apparatus for deep-drawing a product blank to form an article, comprising:

a) a die having a cavity adapted to receive the product blank deep-drawn into an article;

b) a clamp adapted to apply an adjustable force against the product blank; and c) a mandrel including a plurality of nested tool segments, each nested tool segment independently extendable so that a first tool segment housed within a last tool segment engages and forms the product blank before said last tool segment engages and forms a remaining portion of the product blank within the cavity, the combined extended tool segments cooperating to form the article.

22. A method for manufacturing a deep-drawn one-piece article comprising:

clamping a blank at a fixed position in a die assembly;

extending a first inner most draw punch outward from a nested arrangement of draw punch tools to engage and force the fixed blank into a die cavity working first surface area of the blank with said extending first inner most draw punch to reduce thickness;

extending a last draw punch from the nested arrangement and working a last surface area of the blank to reduce thickness, said first reduced surface area through said last reduced surface area providing a bottom of the article being manufactured; and slidably clamping the blank in the die assembly so that said last extending draw punch draws and irons the slidably clamped blank portions within the die cavity, said ironed portion providing a sidewall of the article being manufactured.

23. The method recited in claim 22 whereby said first surface area thickness is reduced by first inner most draw punch causing blank material to flow in an outward direction from said first inner most extending draw punch and toward walls of the die cavity.

24. The method recited in claim 22 whereby said last surface area thickness is reduced by last draw punch from the nested arrangement causing blank material to flow in an outward direction from said last extending draw punch and toward walls of the die cavity.

25. Apparatus for drawing a blank into a product, comprising:

a) a die having a cavity;

b) a clamp to hold the blank, said clamp adapted to apply an adjustable force against the blank; and c) a mandrel including at least two tool segments comprising a first tool segment slidably captured within a second tool segment, said first tool segment and said second tool segment independently extendable to engage and form the blank into the product within said cavity, said first tool segment positioned to engage and draw a first blank portion within said cavity when said first tool segment is extended whereby said clamp applies a force that fixes the blank at a position so that when said first tool segment is extended to draw the first portion of the blank within said cavity, said first tool segment applies a generating force against the fixed blank that reduces thickness along the first portion of the blank.

26. Apparatus for deep-drawing a blank into a product, comprising:

a) a die having a cavity shaped to receive and form a blank into the product;

b) a clamp that provides an adjustable force to control the position of the blank with respect to said cavity; and c) a mandrel having a plurality of independently extendable nested tool segments including;

i) a first tool segment positioned to engage and draw a first blank portion within said cavity;

ii) at least one intermediate tool segment that slidably envelops said first tool segment, said at least one tool segment positioned to engage and draw an intermediate blank portion within said cavity; and iii) a last tool segment that slidably envelops an intermediate tool segment, said last tool segment positioned to engage and draw a last blank portion within said cavity where by said clamp applies a force that fixes the blank at a position so that when said first tool segment is extended to engage and draw the first blank portion within said cavity, said first tool segment generates a force against the fixed blank that reduces thickness along the first blank portion.

27. A method for drawing a blank into a product comprising:

clamping to apply a force that fixes the blank to a die;

providing a mandrel having nested tool segments, each tool segment slidably captured within an adjacent tool segment with a last tool segment slidably enveloping a tool segment;

extending said nested tool segments to engage and draw a portion of the blank within said die to form a partial product;

adjusting said clamp to apply a reduced force that allows controlled blank movement, and extending said last tool segment is to engage and draw the moveable blank portion within said die to form a completed product.

* * * * *